US007034287B2

(12) United States Patent
Okumura et al.

(10) Patent No.: US 7,034,287 B2
(45) Date of Patent: Apr. 25, 2006

(54) MASS SPECTROMETER AND METHOD OF USE

(75) Inventors: Akihiko Okumura, Hachioji (JP); Izumi Waki, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 76 days.

(21) Appl. No.: 10/750,915

(22) Filed: Jan. 5, 2004

(65) Prior Publication Data

US 2004/0164240 A1 Aug. 26, 2004

(30) Foreign Application Priority Data

Feb. 24, 2003 (JP) ..... 2003-045345

(51) Int. Cl.
*H01J 49/40* (2006.01)

(52) U.S. Cl. ..... 250/287; 250/288

(58) Field of Classification Search ..... 250/281, 250/282, 286, 287, 288, 290, 291, 292, 293
See application file for complete search history.

(56) References Cited

U.S. PATENT DOCUMENTS

| | | | | |
|---|---|---|---|---|
| 2,939,952 | A | 6/1960 | Paul et al. | |
| 5,572,022 | A | 11/1996 | Schwartz et al. | |
| 5,652,427 | A * | 7/1997 | Whitehouse et al. | 250/288 |
| 5,696,376 | A * | 12/1997 | Doroshenko et al. | 250/292 |
| 6,627,883 | B1 * | 9/2003 | Wang et al. | 250/292 |
| 6,707,033 | B1 * | 3/2004 | Okumura et al. | 250/281 |

FOREIGN PATENT DOCUMENTS

JP 2001-297730 4/2000

* cited by examiner

*Primary Examiner*—Nikita Wells
*Assistant Examiner*—David A. Vanore
(74) *Attorney, Agent, or Firm*—Reed Smith LLP; Stanley P. Fisher, Esq.; Juan Carlos A. Marquez, Esq.

(57) ABSTRACT

Disclosed is a mass spectrometer combining an ion trap and a TOFMS non-coaxially, wherein ion trapping efficiency, mass resolution, and CID efficiency can be maximized. The present invention relates to the mass spectrometer combining the ion trap and the TOFMS non-coaxially, having a mass filter disposed between an ion source and an ion trap and a controller for controlling the gas pressure inside the ion trap and the gas pressure inside the mass filter independently, wherein the gas pressure inside the ion trap is set to the level higher than that inside the mass filter.

16 Claims, 7 Drawing Sheets

MASS SPECTROMETER AND METHOD OF USE

PRIORITY CLAIM

This application claims priority under 35 USC §119 to Japanese patent application P-2003-045345 filed Feb. 24, 2003, the entire disclosure of which is hereby incorporated herein by reference.

FIELD OF THE INVENTION

The present invention relates to a mass spectrometric approach, and in particular to a mass spectrometer combining an ion trap and a Time-Of-Flight Mass Spectrometer (TOFMS) together and a mass spectrometric method.

BACKGROUND OF THE INVENTION

Against the background of an advance in genome-sequence research, attention has been shifted to proteome analysis, in which proteins expressed in living bodies are exhaustively analyzed. Mass spectrometry is a high-sensitivity and high-throughput protein identification method and considered to be one of major approaches for proteome analysis.

Proteome is analyzed by following the procedure described below. First, the molecular weights of peptide fragments resultant from enzyme-catalyzed digestion of protein are measured. Then, the resulting peptide fragments are further dissociated in a mass spectrometer to measure the molecular weights of individual fragments. The molecular weights of original peptide fragments and of their fragments are searched in a database to identify the target protein.

A method for dissociating sample molecules in the mass spectrometer and analyzing the masses of the fragments thereof is called a MS/MS analysis, an essential approach for proteome analysis.

As one of mass spectrometers capable of MS/MS analysis, an ion trap mass spectrometer is well known. (See, for example, Patent document 1, U.S. Pat. No. 2,939,952.) In this ion trap mass spectrometer, RF voltage is applied between a ring electrode and a pair of end cap electrodes composing the ion trap, forming a quadrupole field in the ion trap to trap and store ions. At that time, the introduction of a neutral gas, for example helium gas, causes kinetic energy of ions to be lost because the ions coming into the ion trap collide against the introduced gas, improving efficiency of ion trapping. After being stored, the ions are ejected from the ion trap starting from one having the smallest m/z ratio by scanning the amplitude of RF voltage and detected, forming a mass spectrum (MS spectrum).

MS/MS analysis is performed using an ion trap mass spectrometer by following the procedure described below. First, ions are stored in the ion trap and by following the procedure described above, a mass spectrum is formed. The ion to be dissociated (a precursor ion or parent ion) is selected among those on the resulting mass spectrum. Then, after being stored again in the ion trap, all the ions excluding the parent ion are ejected from there. This step is commonly called isolation.

As one of the parent ion isolation methods, such a method that auxiliary AC voltages are applied to two endcap electrodes. When the amplitude of auxiliary AC voltage exceeds a certain level, the orbits of the ions go into the unstable state, and the ions are ejected from the inner space of the ion trap.

Next, the parent ion remaining in the ion trap is dissociated. Ion dissociation is commonly performed with Collision Induced Dissociation (CID) With CID, auxiliary AC voltage is applied to two end cap electrodes to increase the kinetic energy of the parent ion, causing it to collide and to dissociate it against a neutral gas, for example, helium gas, which is introduced in the ion trap as a target gas. The target gas also serves as a buffer gas for improving ion trapping efficiency.

Since all of or part of the fragment ions resultant from CID remain trapped and stored in the ion trap, finally the mass spectrum of fragment ions (MS/MS spectrum) can be obtained by scanning the RF voltage to eject the fragment ions stored in the ion trap from there starting from one having the smallest m/z ratio and detect them.

With the ion trap mass spectrometer, the $MS^n$ (n>2) analysis can be performed, in which the parent ion is further selected among the fragment ions and dissociated into smaller fragments to analyze the masses of them. The $MS^n$ analysis provides such an advantage that more detailed information on the structure of the original ion can be obtained. The $MS^n$ analysis is performed by following the procedure described below. First, the $MS^{(n-1)}$ analysis is performed and the parent ion is selected among those on the resulting mass spectrum ($MS^{(n-1)}$ spectrum) Next, the steps up to the immediately before the step for obtaining an additional $MS^{(n-1)}$ spectrum are repeated. After ion isolation and dissociation, the mass spectrum ($MS^n$ spectrum) of the resultant fragments is obtained.

Such a structure that a quadrupole filter is disposed at the front of the ion trap is known (see, for example, Patent document 2, U.S. Pat. No. 5,572,022). In this structure, ions can be isolated inside the quadrupole filter, enabling ion storage and isolation to be performed simultaneously, which improves the duty ratio for ion trapping and resultantly the detection sensitivity in MS/MS analysis.

Such a mass spectrometer is known that the ion trap and a TOFMS are combined in the direction orthogonal to the direction of ion traveling (see, for example, Patent document 3, JP-A No. 297730/2001). With this type of mass spectrometer, ion storage, ion isolation, and CID are performed at the ion trap and the masses of the ions are analyzed in the TOFMS. Mass analysis is performed by following the procedure described below. After the ions are stored in the ion trap, the application of RF voltage is stopped and an electrostatic field is formed to eject the stored ions. The ejected ions go into the inside of the TOFMS, where is being pumped to a high vacuum. Then the ions are accelerated by an electric field orthogonally to the direction of ion travel and the time-of-flight of the ions are measured.

As mentioned above, in the case of an ion trap mass spectrometer, a neutral gas must have been introduced in the ion trap for two purposes, one being the improvement of ion trapping efficiency and the other being the achievement of CID. The pressure of this neutral gas may affect not only ion trapping efficiency and CID efficiency but also mass resolution of the mass spectrum and isolation resolution.

FIG. 2 is a schematic view explaining the subject of the present invention, which indicates the dependency of the performance (101, 102, 103, 104) of the ion trap mass spectrometer according to a prior art (Patent document 1) on the gas pressure inside the ion trap and the operating gas pressure. In FIG. 2, the horizontal axis indicates the gas pressure inside the ion trap and the vertical axis indicates the levels of the performance (101, 102, 103, 104) (as a value becomes higher, the performance become more enhanced). In FIG. 2, the dependency of CID efficiency 101, ion trapping efficiency 102, mass resolution 103, and isolation resolution 104 on the gas pressure are schematically shown. The dependency of mass resolution 103 and isolation resolution 104 on the gas pressure deteriorate as the gas pressure drops and the gas pressure is attained for providing optimal ion trapping efficiency 102 and CID efficiency 101. On the other hand, no optimal gas pressure is attained for providing all the optimal values of CID efficiency 101, ion trapping efficiency 102, mass resolution 103, and isolation resolution 104. Usually, focusing on ion trapping efficiency 102 and mass resolution 103, the gas-pressure for operating the ion trap is set within the region 105, which provides both of acceptable ion efficiency 102 and acceptable mass resolution 103, as shown in FIG. 2.

The duty ratio of the ion trap of a prior art (Patent document 1) is calculated as follows, considering a typical assumption that 100 ms is required for ion storage, 20 ms for isolation, 30 ms for CID, and 200 ms for mass analysis, respectively;

$$(100\ ms)/(100\ ms+20\ ms+30\ ms+200\ ms)=0.285.$$

According to a prior art (Patent document 2), because ion storage and isolation can be simultaneously performed, the duty ratio is calculated as follows:

$$(100\ ms)/(100\ ms+30\ ms+200\ ms)=0.303.$$

In this case, the duty ratio is slightly improved from 0.285 to 0.303. Moreover, since only parent ion is introduced into the ion trap, the injected ions/unit period of time can be reduced and therefore the period of time for storing ions until the ion trap is filled with ions can be increased. As the result, the duty ratio and the detection sensitivity can be improved.

For example, if the period of time for storing ions until the ion trap is filled with ions can be prolonged to 500 ms, the duty ratio will be improved to the value obtained from the formula below:

$$(500\ ms)/(500\ ms+30\ ms+200\ ms)=0.684.$$

For this reason, it is expected that the sensitivity can be improved by a factor obtained from the formula below;

$$0.684/0.285=2.4.$$

From the descriptions above, it can be known that the main cause for deterioration in duty ratio in the ion trap mass spectrometer is a relatively long dead-time, about 200 ms, during mass analysis.

According to a prior art (Patent document 2), however, the dependency of mass resolution, CID efficiency, and ion trapping efficiency on the gas pressure are identical to those for the ion trap mass spectrometer disclosed in Patent document 1 and no gas pressure cannot be attained for providing all of acceptable performances. For this reason, the gas pressure is set within the same region as that of the ion trap mass spectrometer according to the prior art (Patent document 1).

In the system according to the prior art (Patent document 3), the subject of improving the duty ratio described in Patent document 2 has been spontaneously solved without a quadrupole filter disposed at the front of the ion trap, thanks for high speed of TOF mass spectrometry. This means that even if 100 ms is required for ion storage, 20 ms for ion isolation, and 30 ms for CID, respectively, only less than 1 ms is needed for mass analysis in the TOF system. For this reason, since the duty ratio has already reached to the level obtained from the formula below: (100 ms)/(100 ms+20 ms+30 ms+1 ms)=0.662, without a quadrupole filter disposed. Even if the duty ratio is increased toward a value 1 by omitting the isolation time or prolonging the ion storage period of time as the result of disposing a quadrupole filter at the front of the ion trap, the effect of the sensitivity improvement is small against the new problems of more complicated instrument and increased cost, which occur by the disposition of the quadrupole filter. Consequently, in the system according to the prior art (Patent document 3), no quadruple filter needs to be disposed at the front of the ion trap TOF analyzer only from the knowledge of the improvement of the duty ratio of the system according to the prior art (Patent document 2).

On the other hand, the mass resolution of the TOFMS becomes higher as the initial ion state, namely ion dispersion in the space and energy distribution at the moment of voltage being applied to form a electric field for ion acceleration, are smaller in the direction of accelerating ions. The ion dispersion in the space and the energy distribution are smaller as the gas pressure becomes higher inside the ion trap. That is because since the ion dispersion in the space and the energy distribution are smaller as the gas pressure inside the gas trap becomes higher, the ion dispersion in the space and the energy distribution can be easily controlled in the direction orthogonal to the ion ejected from the ion trap. Thus, the mass spectrometer according to the prior art (Patent document 3) has a feature that higher mass resolution is attained as the gas pressure inside the ion trap becomes higher, contrary to the ion trap mass spectrometer.

FIG. 3 is a schematic view further explaining the subject of the present invention, which indicates the dependency of the performances of the mass spectrometer combining the ion trap and the TOFMS together according to the prior art (Patent document 3) on the gas pressure and the operating gas pressure. In FIG. 3, the horizontal axis indicates the gas pressure inside the ion trap and the vertical axis indicates the levels of the performances (a higher value indicates a higher performance). In FIG. 3, the dependency of CID efficiency 101, ion trapping efficiency 102, mass resolution 103, and isolation resolution 104 on the gas pressure are schematically shown. As known from FIG. 3, the gas-pressure region is attained for providing approximately maximum ion trapping efficiency 102, mass resolution 103, and CID efficiency 101 simultaneously. As shown in FIG. 3, the gas-pressure region 105 for providing all of acceptable ion efficiency 102, mass resolution 103, CID efficiency 101, and isolation resolution 104 is achieved for operating the ion trap.

However, like the ion trap mass spectrometer, the isolation resolution 104 deteriorates as the gas pressure becomes higher. For this reason, the system according to the prior art disclosed in Patent document 3 has a problem that no gas pressure can be attained for providing all of optimal isolation resolution 104, ion trapping efficiency 102, mass resolution 103, and CID efficiency 101.

As described above, with the ion trap mass spectrometer, a neutral gas, for example helium gas, must have been introduced into the ion trap serving as both of a target gas for CID and a buffer gas for improving ion trapping efficiency. Either of CID efficiency and ion trapping efficiency depends on the gas pressure and has optimal values.

On the other hand, mass resolution and isolation resolution deteriorate as the gas pressure becomes higher. For this reason, no gas pressure can be attained for providing all of approximately maximum ion trapping efficiency, mass resolution, isolation resolution, and CID efficiency simultaneously.

In the system according to the prior art (Patent document 2), isolation resolution does not depend on the gas pressure inside the ion trap because a quadrupole filter is disposed at the front of the ion trap for isolating ions there. No gas pressure, however, can be attained for providing all of approximately maximum ion trapping efficiency, mass resolution, and CID efficiency simultaneously.

The mass spectrometer according to the prior art combining the ion trap and the TOFMS together (Patent document 3) has a feature contrary to the instruments according to the prior arts (Patent document 1) and (Patent document 2) in that mass resolution is more improved as the gas pressure becomes higher. Nevertheless, no gas pressure can be attained for providing all of maximum ion trapping efficiency, mass resolution, and isolation resolution simultaneously.

SUMMARY OF THE INVENTION

The object of the present invention is to provide a mass spectrometer combining an ion trap and a TOFMS together, which can provide approximately maximum CID efficiency, mass resolution, and CID efficiency simultaneously, and a mass spectrometric method using it.

To attain the object described above, according to the present invention, in a mass spectrometer, which has the ion trap and the TOFMS combined together non-coaxially, for example in the direction orthogonal to the direction of ion ejection from the ion trap, a mass filter (for example, a quadrupole filter) is disposed at the front of the ion trap for isolating ions there. The gas pressure inside the mass filter and the gas pressure inside the ion trap are controlled independently, the gas pressure inside the mass filter being optimized for maximizing isolation resolution and the gas pressure inside the ion trap being optimized for approximately maximizing all of ion trapping efficiency, mass resolution., and CID efficiency simultaneously.

According to the present invention, the mass spectrometer is structured so that it has a 3D quadrupole ion trap for ejecting the ions, after ions generated at an ion source are stored in the ion trap for a certain period of time, and a TOFMS for accelerating the ions ejected from the ion trap orthogonal to the direction of the ejection and measuring the time-of-flight of the accelerated ions, wherein a mass filter is disposed between the ion source and the ion trap, and the gas pressure inside the ion trap and the gas pressure inside the mass filter are controlled independently.

The gas pressure inside the trap is set to a higher level than that inside the mass filter, the ions being passed through the mass filter and stored in the ion trap are dissociated therein, and the masses of the fragment ions resultant from ion dissociation are analyzed using the TOFMS. The mass filter may be comprised of three-stage of quadrupoles, the gas pressure in the second-stage of quadrupole is controlled to the lower level than those of the first-stage and third-stage quadrupoles. Among the peaks on the mass spectrum which has the intervals between neighboring peaks exceeding the value pre-determined based on the isolation resolution of the mass filter on the mass spectrum, is selected and the ion corresponding to the selected peak is isolated at the mass filter. The selected peak is displayed on the monitor screen.

The mass spectrometric method of the present invention includes a step for generating sample ions at an ion source, a step for ejecting the ions, after storing ions generated at the ion source in the 3D quadrupole ion trap for a certain period of time, a step for analyzing the masses of the ions and/or fragment irons resultant from ion dissociation using the TOFMS, which accelerates the ions ejected from the ion trap in the direction orthogonal to the direction of the ejection, and a step for controlling the gas pressure inside the mass filter disposed between the ion source and the ion trap and the gas pressure inside the ion trap independently.

In the controlling step, the gas pressure inside the ion trap is set to a higher level than that inside the mass filter. The method of the present invention includes a step for dissociating the ions stored in the ion trap through the mass filter therein to produce fragment ions resultant from ion dissociation. Moreover, it may have a mass filter comprised of three-stages quadrupoles and further include a step for controlling so that the gas pressure inside the second-stage quadrupole to lower level than that inside of the first-stage and third-stage quadrupole. Further, it may include a step for selecting mass spectral peaks, which has the intervals between neighboring peaks exceeding the value pre-determined based on the isolation resolution of the mass filter, among the peaks on the mass spectrum and a step for isolating the ion associated with the selected peak at the mass filter, wherein the selected peak is displayed on the monitor screen.

DETAILED DESCRIPTION OF THE PREFERRED EMBODIMENTS

Figure 1:
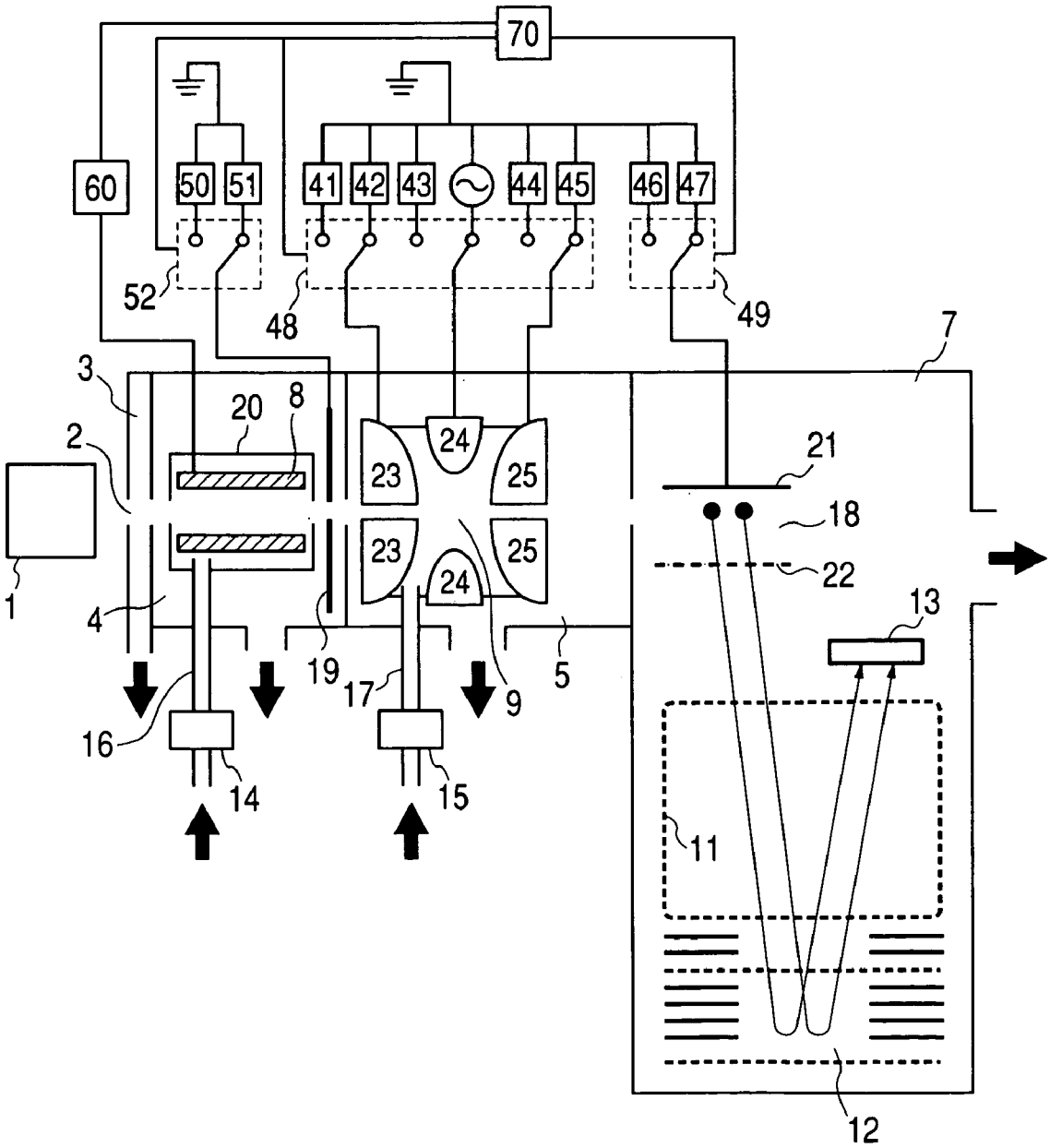
FIG. 1 is a schematic view showing an example of a mass spectrometer according to an embodiment of the present invention.
Figure 2:
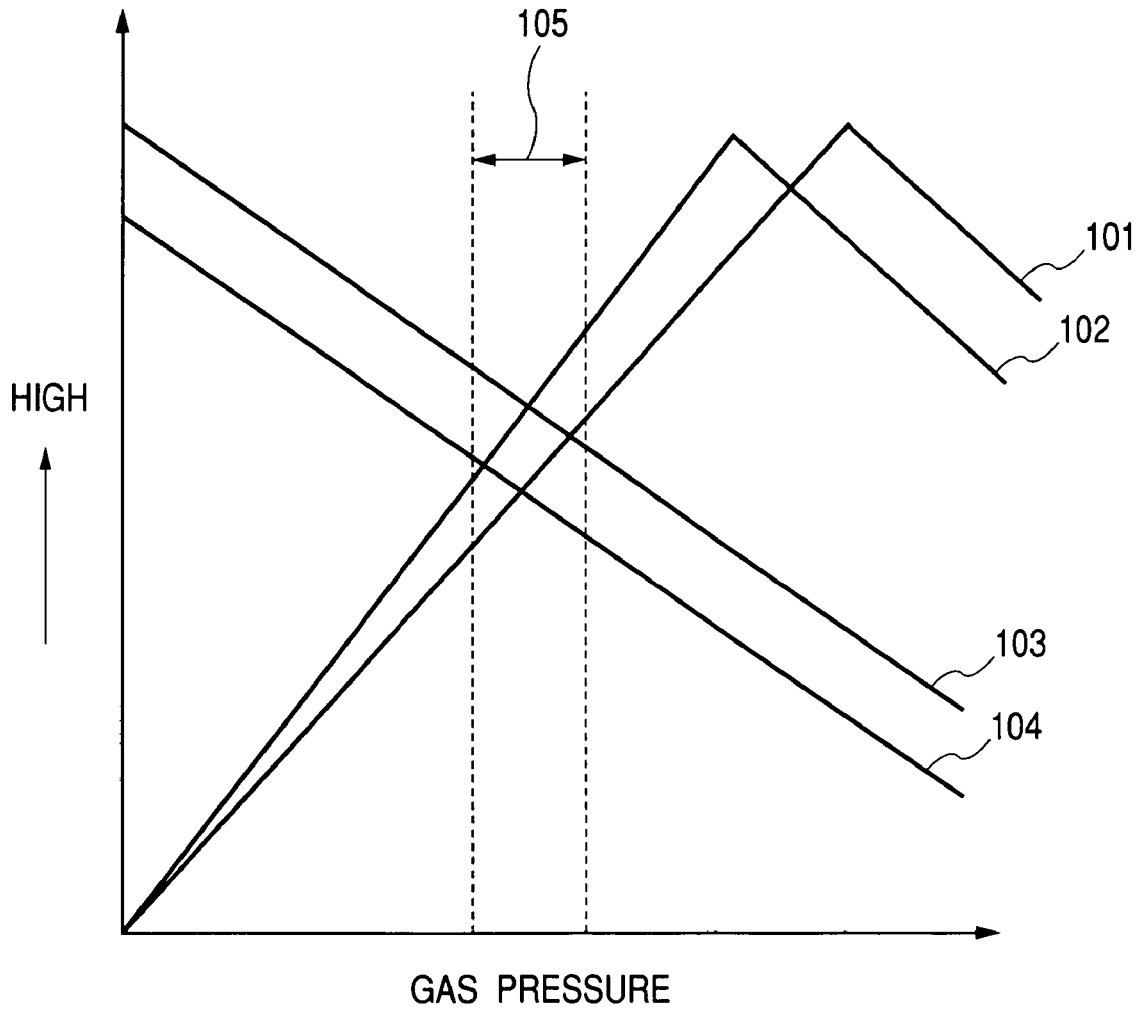
FIG. 2 is a schematic view showing the dependency of the performances of an ion trap mass spectrometer according to the prior art on the gas pressure inside the ion trap and its operating gas pressure range.

FIG. 1 is a schematic view showing an example of the mass spectrometer according to the present invention.

Samples are ionized at an atmospheric-pressure ion source 1. The ions generated at the ion source 1 go into a first vacuum chamber 3 through a sampling orifice 2 and then into a second vacuum chamber 4. The ions go through a mass filter (for example, a quadrupole filter) 8 disposed inside the second vacuum chamber 4 and a gate electrode 19. Next, the ions go into a third vacuum chamber 5 and then into a 3D quadrupole ion trap 9 disposed inside of it. At that time, voltage has been applied to the gate electrode 19 for providing the ions to go through there.

Inside the ion trap, a neutral gas (for example, helium, nitrogen, or argon) has been introduced through a tubing 17 and the ions passing into the ion trap are trapped around its center while losing their kinetic energy though repeated collisions against the neutral gas. The gas pressure inside the ion trap can be controlled by adjusting a flow rate of gas using a valve 15.

The quadrupole filter 8 is disposed inside a housing 20, inside which the neutral gas (for example, helium, nitrogen, or argon) is introduced through a gas tube 16. Since the quadrupole filter 8 may improve the rate of ion introduction into the ion trap 9 by focusing ion beams, a certain level of gas pressure is required. The gas pressure inside the quadrupole filter 8 can be controlled by adjusting the gas flow rate of a gas tube 16 using a valve 14.

After the ions being introduced into the ion trap 9 and stored for a certain period of time, a DC power source 51 is changed to a DC power source 50 using a switch 52 to set the voltage applied to the gate electrode 19 to a level, at which the ions cannot pass through there, stopping ion introduction into the ion trap 9.

The ion trap is comprised of a pair of end cap electrodes 23 and 25, and a ring electrode 24. During ion storage RF voltage is applied to the ring electrode and the potentials at the end cap electrodes are at 0 V level. When the masses of the ions stored in the ion trap are analyzed, a switch 48 is used to change from a AC power source 42 to a DC power source 41, from a RF power source to a DC power source 43, and the AC power source to the DC power source 41, respectively, stopping the application of RF voltage to the ring electrode 24 and at the time, appropriate DC voltages are applied to two end cap electrode 23 and 25, and the ring electrode 24, respectively to form a electrostatic field for ejecting the ions.

The ions are ejected from the ion trap and come into a fourth vacuum chamber 7. The ions coming into the fourth vacuum chamber fly in the inner space of an orthogonal accelerating element 18 disposed therein. During ion passing through the inner space of the orthogonal accelerating element 18, a switch 49 is used to change a DC power source 47 to a DC power source 46 to apply about 1 kV to 10 kV of pulse voltage to an accelerating electrode 21, which accelerates the ions in the electric field in the direction orthogonal to the direction of ion traveling. The accelerated ions are further accelerated between electrodes 22 and 11, flying in a field-free space defined by the electrode 11, and come into a reflectron 12.

Note that the first vacuum chamber 3, the second vacuum chamber 4, the third vacuum chamber 5, and the fourth vacuum chamber 7, is exhausted of the air independently.

The ions are reversed in the reflectron 12 and fly through the field-free space into a detector 13. Measured is the time-of-flight of the ions from the application of voltage to the orthogonal accelerating element 18 to the arrival of the ions to the detector 3. Using such a characteristic that the time of flight depends on the ion's m/z value, a mass spectrum can be obtained.

A controlling element 70 controls the timings for switching switches 48, 49, and 52, respectively. In addition, the controlling element 70 changes operating modes of the quadrupole filter 8 by controlling a power source 60.

Depending on the method for applying voltage to the electrodes composing the quadrupole filter 8, the quadrupole filter can be operated as either an ion guide or a mass filter.

When MS analysis is performed, the quadrupole filter 8 is operated as an ion guide to introduce the ions in the whole m/z range into the ion trap 9. In MS/MS analysis, during ion storage in the ion trap 9, a quadrupole filter is operated as a band pass filter to introduce only the parent ion into the ion trap 9. Then, the ions stored in the ion trap 9 are dissociated by CID and the masses of the fragrant ions, which are stored in the ion trap, are analyzed in the same procedure as that for MS analysis.

During a period from the application of DC voltages for ejecting the ions to the ion trap 9 to the application of pulse voltage to the orthogonal accelerating element 18, the next ion storage process is initiated. This interval is usually about 10 to 50 μs, while the time for the ion storage is about 10 ms to 1 s, at which any loss of the sample ions is negligible.

By adjusting the pumping speeds, the diameter of ions' passes between adjacent vacuum chambers, and the diameter of a sampling orifice 2 (ions' pass between the atmospheric-pressure space and the first vacuum chamber 3), and further adjusting the gas flow rate using the valve 15, the gas pressure inside the ion trap 9 can be set to Pmax (about $10^{-1}$–$10^{-2}$ Torr) so that ion trapping efficiency, mass resolution, and CID efficiency may be approximately maximized and by adjusting the gas flow rate using he valve 14, the gas pressure inside the quadrupole filter can be set to the level lower than Pmax.

The degree of vacuum in the fourth vacuum chamber 7, where the TOFMS is disposed, is kept at a level, at which the TOFMS can demonstrate sufficiently its performances, by increasing the pumping speed for the third vacuum chamber 5 or that for the fourth vacuum chamber 7, because the ion trap is operated at a region of gas pressure higher than that for the mass spectrometer according to the prior art.

Figure 4A:
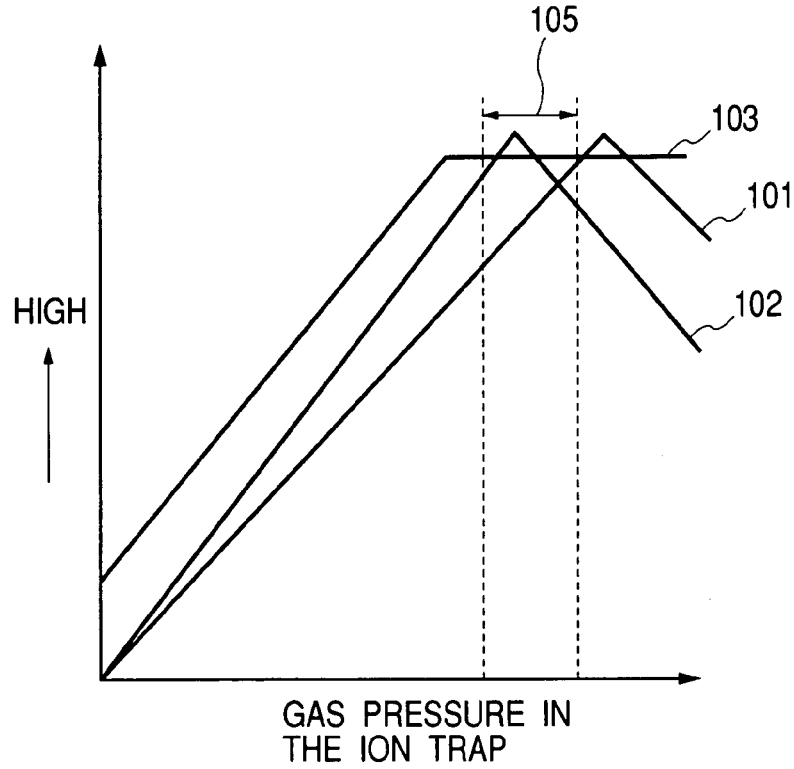
FIG. 4A and FIG. 4B are schematic views showing the dependency of the performances of a mass spectrometer according to an embodiment of the present invention on the gas pressure inside the ion trap and its operating gas pressure range (FIG. 4A) and on the gas pressure inside the quadrupole filter and its operating gas pressure range (FIG. 4B)
Figure 4B:
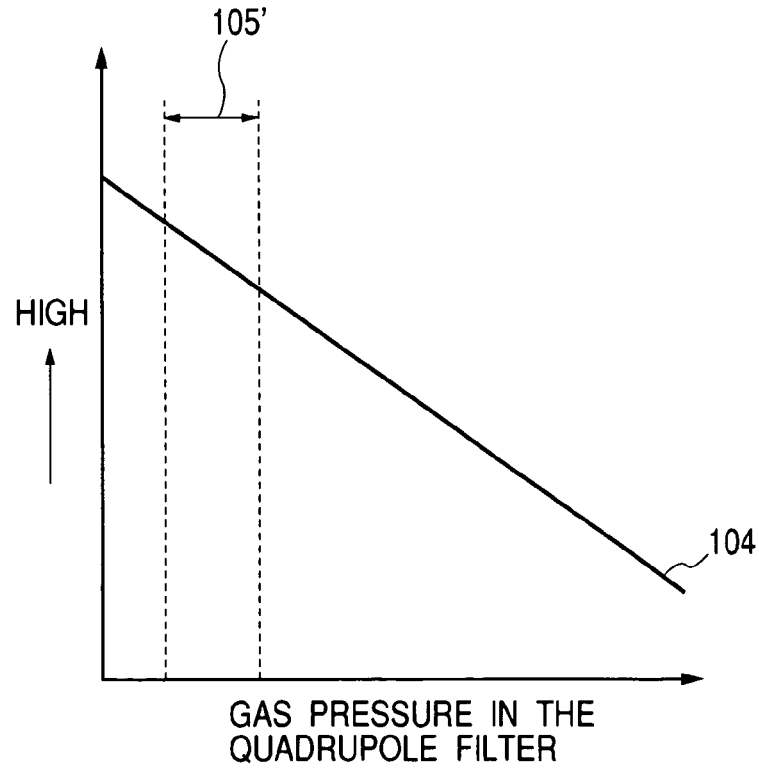

FIG. 4A is a schematic view showing the dependency of the performances of a mass spectrometer according to an embodiment of the present invention (ion trapping efficiency, mass resolution, and CID efficiency) on the gas pressure inside the ion trap and the operating gas pressure range. In FIG. 4A, the horizontal axis indicates the gas pressure inside the ion trap and the vertical axis indicates the levels of the performances (a higher value indicates a higher performance). On the other hand, FIG. 4B is a schematic view showing the dependency of isolation resolution on the gas pressure inside the quadrupole filter and the operating gas pressure range. In FIG. 4B, the horizontal axis indicates the gas pressure inside the quadrupole filter and the vertical axis indicates the level of the performance (a higher value indicates a higher performance).

According to an embodiment of the present invention, the ion trap 9 is operated in the gas-pressure region, where all of, one of, or two of ion-trapping efficiency 102, mass resolution 103, and CID efficiency 101 are maximized or in the vicinity of the gas-pressure region described above. The gas-pressure region for operating the quadrupole filter is set and controlled independently from the gas-pressure region for operating the ion trap 9 and optimized for isolation resolution. The gas-pressure region 105' for operating the quadrupole filter 8 is set and controlled to the lower level than that of the gas-pressure region 105 for operating the ion trap 9.

Figure 5:
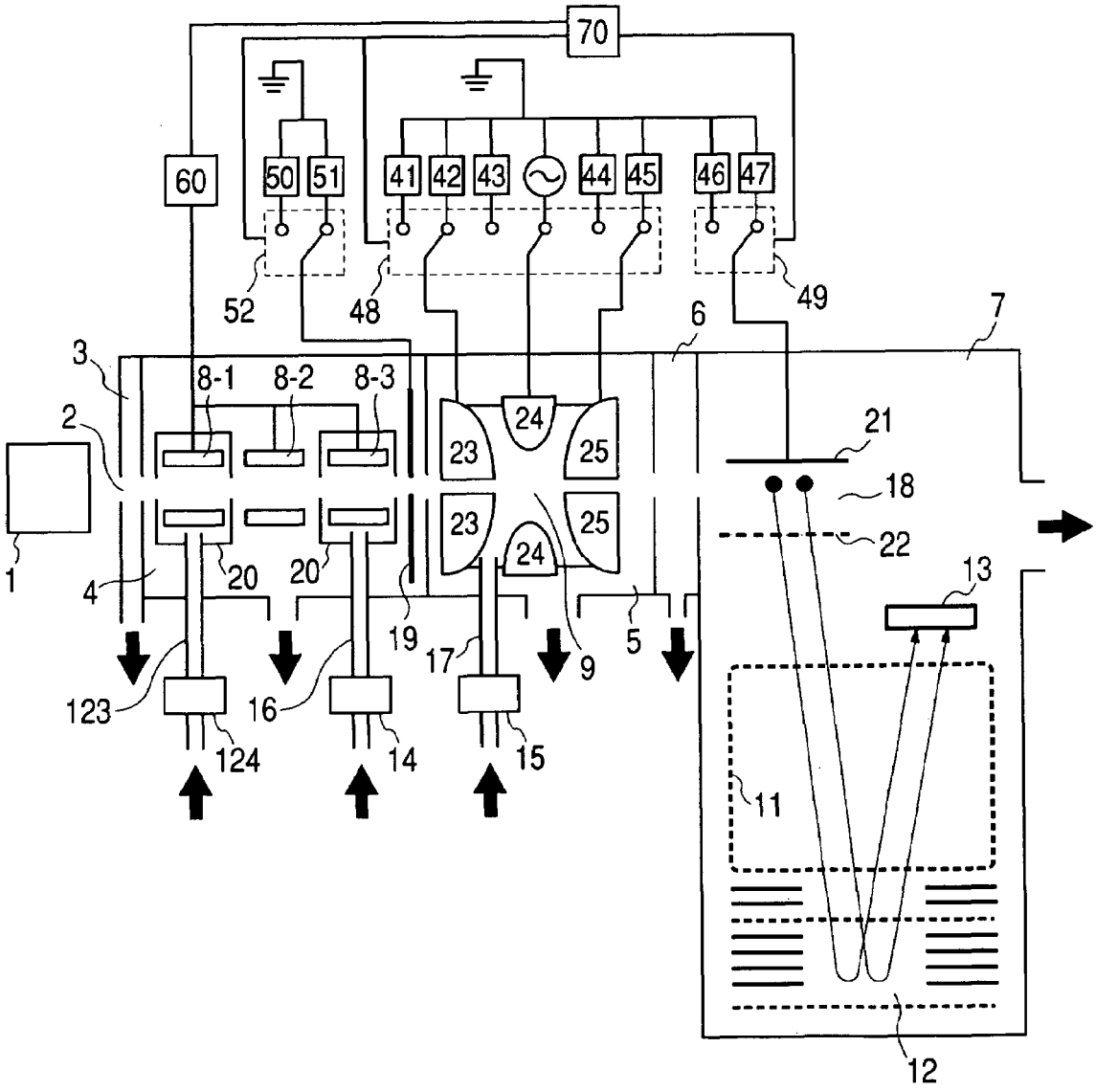
FIG. 5 is a structural view showing an example of the mass spectrometer according to another embodiment of the present invention.

FIG. 5 is a schematic view showing an example of the mass spectrometer according to an embodiment of the present invention. Isolation resolution increases as the gas-pressure in the quadrupole filter drops. On the other hand, the number of ions coming into the ion trap 9 is increased by focusing the ion beam toward the center axis of the quadrupole filter. To make this function effective, a certain level of gas pressure (about $10^{-3}$–$10^{-4}$ Torr) is needed. To solve this problem, part of the schematic view shown in FIG. 1 is modified so that the quadrupole element may be comprised of quadrupole 8-1, 8-2, and 8-3 as shown in FIG. 5.

Like the control element shown in a schematic view shown in FIG. 1, the control element 70 controls the timings for switching the switch 48, 49, and 52. In addition, the control element 70 controls a power source 60 for controlling the operating modes of the quadrupole 8-1, 8-2, and 8-3.

The first-stage quadrupole 8-1 is disposed in a housing 20, into which the neutral gas (for example, helium, nitrogen, or argon) is introduced through a gas tube 123. The gas pressure inside the quadrupole 8-1 is controlled by adjusting the gas flow rate of gas tube 123 using a valve 124. The third-stage quadrupole 8-3 is disposed in the housing 20, into which the neutral gas (for example, helium, nitrogen, or argon) is introduced through a gas tube 16. The gas pressure inside the quadrupole 8-3 is controlled by adjusting the gas flow rate of the gas tube 16, using the valve 14.

Similarly, in the schematic view shown in FIG. 5, the ion trap 9 is operated in the gas-pressure region 105, where all of, one of or two of ion-trapping efficiency 102, mass resolution 103, and CID efficiency 101 are maximized or in the vicinity of the gas-pressure region 105, as shown in FIG. 4.

Figure 3:
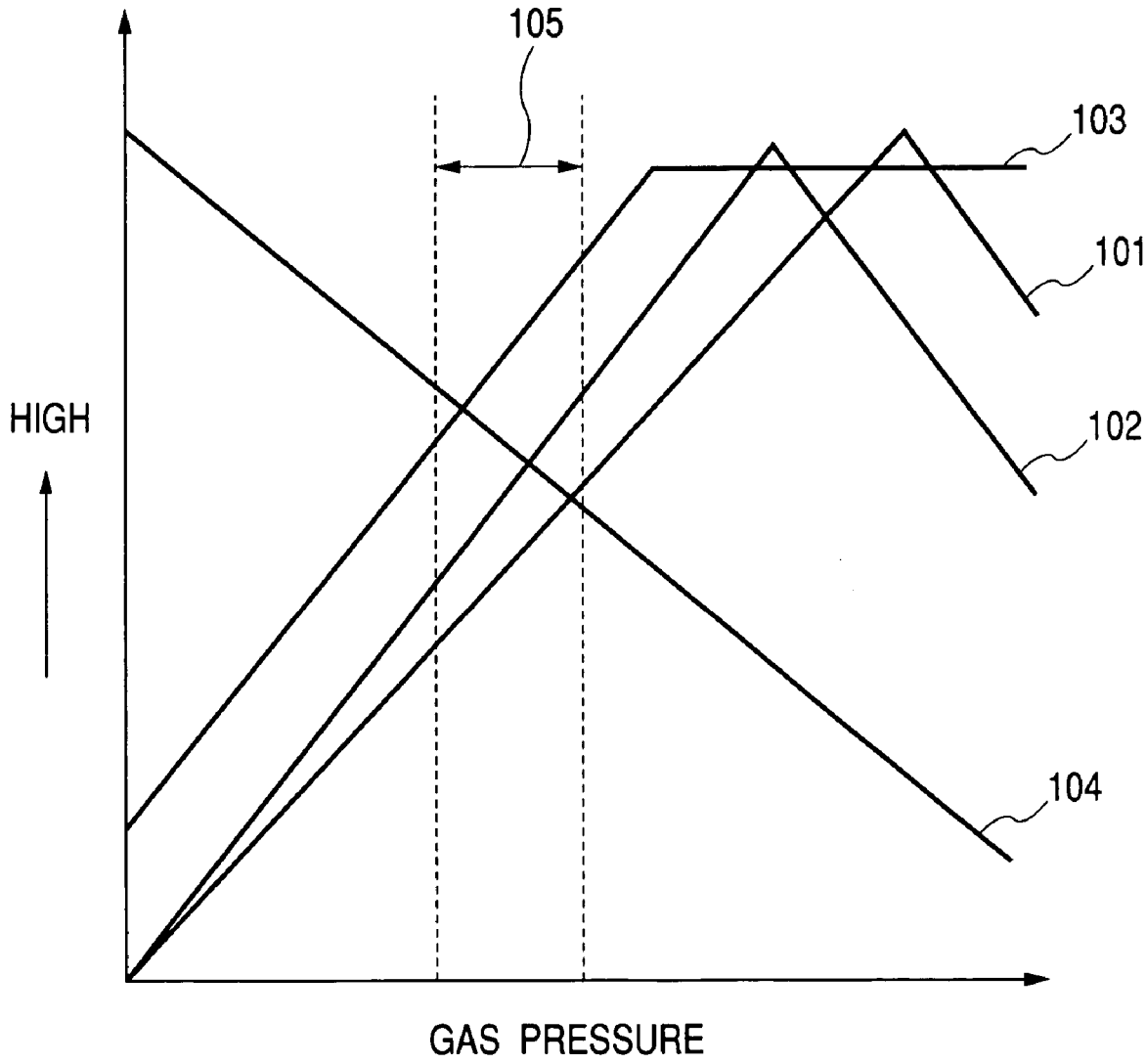
FIG. 3 is a schematic view showing the dependency of the performances of a mass spectrometer combining the ion trap and the TOFMS together non-axially on the gas pressure inside the ion trap and its operating gas pressure range.

The gas-pressure region for operating the quadrupole 8-1, 8-2, and 8-3 is set and controlled independently from the gas-pressure region 105 for operating the ion trap 9, and optimized for isolation resolution. The degree of vacuum in the fourth vacuum chamber 7, where the TOFMS is disposed, can be kept at a level, at which the TOFMS demonstrates sufficiently its performances by increasing the pumping speed for pumping air from the third vacuum chamber 5 or for pumping air from the fourth vacuum chamber 7 in the schematic view shown in FIG. 3, because the ion trap is operated at a region of gas pressure higher than that of the mass spectrometer according to the prior art.

In the example of the schematic view shown in FIG. 5, the fifth vacuum chamber 6 is added between the third vacuum chamber 5 and the fourth vacuum chamber 7 and air is exhausted independently from the first vacuum chamber 3, the second vacuum chamber 4, the third vacuum chamber 5, the fourth vacuum chamber 7, and the fifth vacuum chamber 6 to keep the degree of vacuum in the fourth vacuum chamber 7 at a level, at which the TOFMS can demonstrate sufficiently its performances.

It is possible to set the gas pressure inside the second stage quadrupole 8-2 to the level as lower as possible (about $10^{-3}$–$10^{-4}$ Torr) and use the quadrupole 8-2 for isolation and set the gas pressure P inside the first-stage quadrupole 8-1 and the second-stage quadrupole 8-3 to the level required for focusing the ion beam (about $10^{-1}$–$10^{-2}$ Torr).

The gas pressure inside the quadrupole 8-2 can be controlled to the level lower than those inside the quadrupoles 8-1 and 8-3 by adjusting the valves 124 and 14.

Although the ion beam is focused in the first-stage quadrupole 8-1, they may defocus at the interface between the first-stage quadrupole 8-1 and the second-stage quadrupole 8-2. The third-stage quadrupole 8-3 has a function for focusing the defocused beam again.

When MS/MS analysis is performed, first, MS analysis is made to obtain a mass spectrum. A parent-ion peak is selected among the peaks on the mass spectrum. Next, during ion storage into the ion trap, the quadrupole is operated as a band pass filter, through which only the selected parent ion may pass.

Figure 6A:
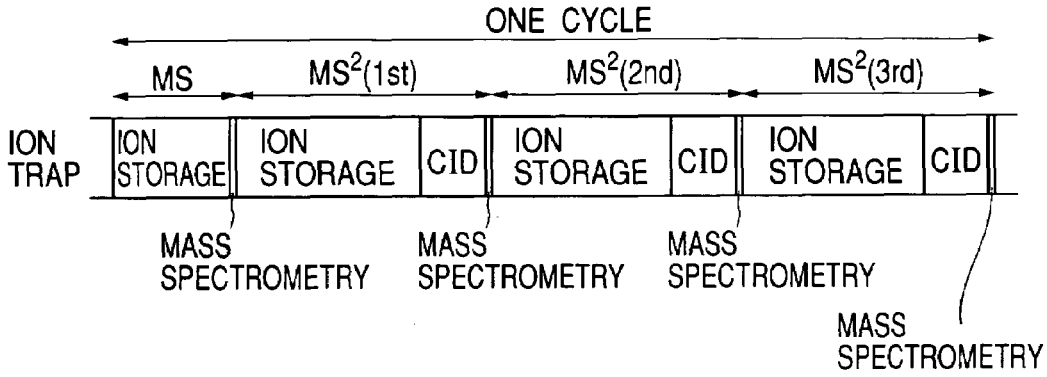
FIG. 6A, FIG. 6B and FIG. 6C are views showing examples of the operating sequences in performing MS/MS analysis according to an embodiment of the present invention.
Figure 6B:
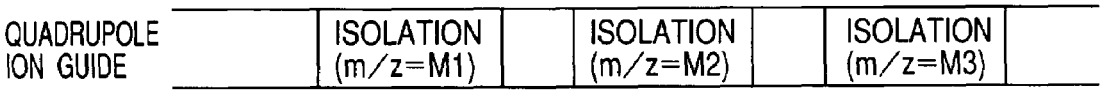
Figure 6C:
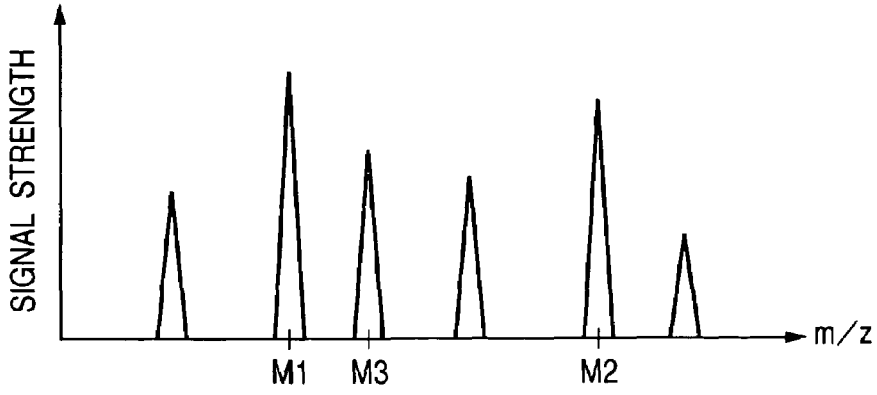

FIG. 6A, FIG. 6B, and FIG. 6C are views showing an example of the operation sequence for MS/MS analysis. FIG. 6A shows operation sequence for the ion trap and FIG. 6B shows operation sequence for the quadrupole.

(1) The ions are stored in the ion trap for a certain period of time and the masses of the stored ions are analyzed (MS in FIG. 6A). At this point, no isolation is performed in the quadrupole. In FIG. 6C, the resulting mass spectrum is shown.

(2) Only ions having an m/z ratio of M1 are stored in the ion trap for certain period of time while isolation is being performed using the quadrupole. Next, the stored ions are dissociated by CID to analyze the masses of the fragments resultant from ion dissociation ($MS^2$ (1st) in FIG. 6A).

(3) In the same manner as those described in (2), the ions having the m/z ratio of M2 are analyzed ($MS^2$ (2nd) in FIG. 6A)

In this way, MS/MS analysis is performed on the ions having up to the m/z ratio of Mn. M1 to Mn are selected among those on the mass spectrum obtained in (1), for example in the order of the intensity of peak being larger. The user (the measurer) is responsible for setting the value for n. Note that generally, to improve the S/N ratio, the individual sequences are repeated and the mass spectra are integrated several times.

In MS/MS analysis, isolation resolution can be improved without ion trapping efficiency, mass resolution, and CID efficiency being deteriorated because isolation can be performed at the low gas-pressure quadrupole element. In addition, the duty ratio is improved because ion storage and isolation are simultaneously performed and, the effect of improving detection sensitivity can be also attained.

Figure 7A:
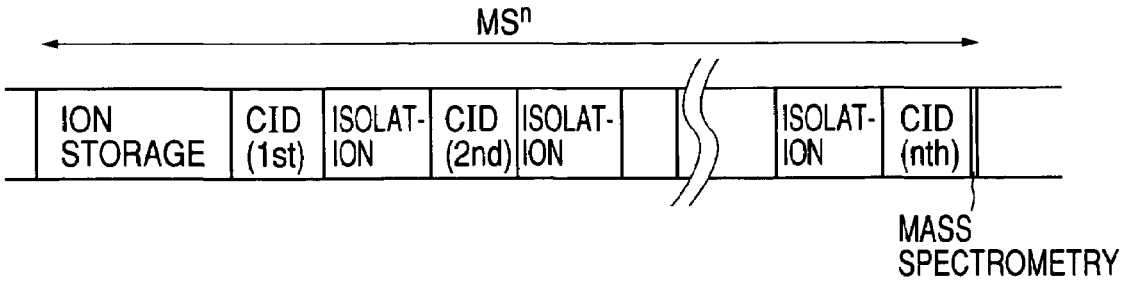
FIG. 7A and FIG. 7B are views showing examples of the operating sequences in performing $MS^n$ (n>2) analysis according to an embodiment of the present invention.
Figure 7B:
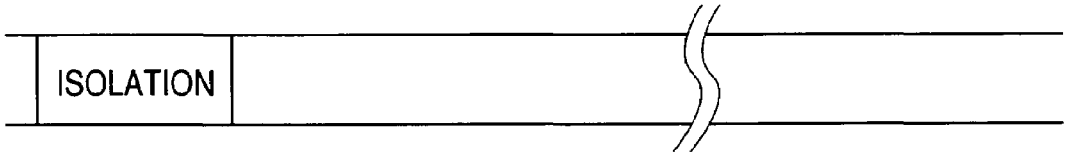

FIG. 7A and FIG. 7B are schematic views showing an example of the operation sequence in performing $MS^n$ (n>2) according to an embodiment of the present invention. FIG. 7A shows the ion trap operation sequence and FIG. 7B shows the quadrupole operation sequence.

(1) $MS^{(n-1)}$ is performed.

(2) While isolation is being performed at the quadrupole element, only the ions having an m/z ratio of M1 are stored in the ion trap for a certain period of time and the stored ions are dissociated by CID.

(3) Only the ions having an m/z ratio of, for example M2, among the fragment ions are isolated in the ion trap and the isolated ions are dissociated by CID.

(4) The step (3) is repeated (n−1) times.

(5) The masses of the fragment ions are analyzed.

When $MS^n$ (n>2) is performed, the first isolation is performed at the quadrupole element (FIG. 7B). The first CID is performed on the ions after being stored (FIG. 7A). Next, the second isolation is performed inside ion trap and then the second CID is performed (FIG. 7A). After then, this operating sequence is repeated.

Generally, in the first isolation, higher isolation resolution is desired because random noise ions, any other peptide fragments, and solvent-derived ions must be removed, though lower isolation resolution may be acceptable in the second or succeeding isolations compared with that in the first isolation. For this reason, the gas pressure inside the ion trap can be set to the level, at which ion trapping efficiency, mass resolution, and CID efficiency may be maximized.

The parent ion can be selected in either the manual or auto-select mode.

In the auto-select mode, generally, a specified number of ions are selected by software in the order of the intensity of peak being higher. Any adjacent peaks, which cannot be completely removed by isolation, may exist in the vicinity of the selected peak. In this case, the mass spectrum of fragments may be misunderstood, leading to an error in identifying original ions. To solve this problem, such a preventive means may be considered that the presence of peaks in the vicinity to the target peak, which cannot be removed, is determined based on the isolation resolution of the instrument and if any, the peak is not selected. Note that it goes without saying that the criterion for determination depends on the place, where the isolation is performed, the quadrupole filter or the ion trap, because isolation resolution is different.

Figure 8:
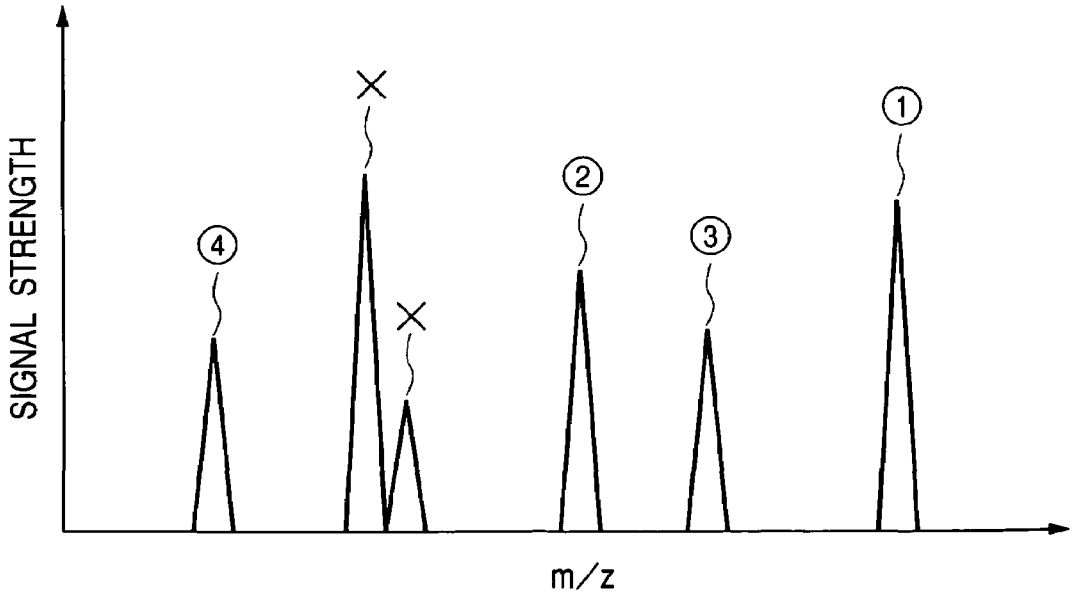
FIG. 8 is a view showing an example of monitor screen displayed for selecting a precursor ion according to an embodiment of the present invention.

FIG. 8 is a view showing an example of monitor screens displayed for selecting parent ions according to an embodiment of the present invention. FIG. 8 shows an example of the screen displayed on the monitor of the instrument, which indicates a mass spectrum showing the result of the steps for selecting the parent ion. The peaks indicated by circled nos. 1 to 4 are the peaks selected as those associated with the parent ions. Two peaks with no label (indicated by x) are excluded from selection because they cannot be isolated at the isolation resolution of the instrument.

In FIG. 8, the numbers are given to the peaks in the order of the intensity of peak being higher, though they may be given in the order of the m/z ratio being smaller. In the manual measurement mode, prior to MS/MS analysis or $MS^n$ analysis, the mass spectrum is displayed on the monitor screen as shown in FIG. 8. The peaks with numbers given are candidate for the parent ion and the measurer is responsible for selecting the target peak in performing MS/MS analysis or $MS^n$ analysis.

In the mass spectrometer combining the ion trap and the TOFMS, the quadrupole element is disposed at the front of the ion trap, at which isolation is performed. This structure enables the gas pressure inside the ion trap to be set in the region, where ion trapping efficiency, mass resolution, and CID efficiency are simultaneously maximized. On the other hand, the gas pressure inside the quadrupole element can be set to a relatively low level appropriate for isolation.

Thus, detection sensitivity, mass resolution, and CID efficiency can be improved without isolation resolution deteriorated. Using the mass spectrometer with enhanced performances, analysis efficiency can be improved in especially, analyzing proteome.

According to the present invention, the mass spectrometer combining the ion trap and the TOFMS non-coaxially, wherein ion trapping efficiency, mass resolution, and CID efficiency can be simultaneously improved and the mass spectrometric method using it may be implemented.

What is claimed is:

1. A mass spectrometer comprising:

an ion source which generates ions;

a mass filter which selects ions of a desired mass-to-charge ratio;

a 3D quadrupole ion trap including a ring electrode and a pair of endcap electrodes, in which the selected ions are fragmented into ion fragments;

a Time-Of-Flight Mass Spectrometer (TOFMS) for accelerating the ion fragments towards a detection means and measuring time-of-flights of the ion fragments; and a controller which switches off an RF voltage applied to the ring electrode, and then applies a DC potential to the ring and endcap electrodes so as to eject the ion fragments from the ion trap into the TOFMS.

2. A mass spectrometer according to claim 1, wherein a first gas pressure inside the ion trap is set to a level higher than a second gas pressure inside the mass filter.

3. A mass spectrometer according to claim 2, wherein the mass filter is comprised of three-stage quadrupoles, said spectrometer further comprising:

a means for controlling gas pressure inside the mass filter so that the gas pressure inside the second one of the three-stage quadrupoles is lower than those inside the first and the third ones of the three-stage quadrupoles.

4. A mass spectrometer according to claim 1, wherein the mass filter is comprised of three-stage quadrupoles, said spectrometer further comprising:

a means for controlling a gas pressure inside the mass filter so that the gas pressure inside the second one of the three-stage quadrupoles is lower than those inside the first and the third ones of the three-stage quadrupoles.

5. A mass spectrometric method comprising:

generating sample ions at an ion source;

selecting ions of a desired mass-to-charge ratio by a mass filter;

fragmenting the selected ions in a three dimensional quadrupole ion trap comprised of a ring electrode and a pair of endcap electrodes;

ejecting the ion fragments from the ion trap into the Time-Of-Flight Mass Spectrometer (TOFMS) using a controller which switches off a RF voltage applied to the ring electrode and then applies a DC potential to the ring and endcap electrodes; and measuring time-of-flights of the ion fragments using the TOFMS which accelerates the ion fragments towards a detection means.

6. A mass spectrometric method according to claim 5, wherein a first gas pressure inside the ion trap is set to a higher level than a second gas pressure inside the mass filter in the controlling step.

7. A mass spectrometric method according to claim 6, wherein the mass filter is comprised of three-stage quadrupoles, said spectrometer further comprising:

a means for controlling gas pressure inside the mass filter so that the gas pressure inside the second one of the three-stage quadrupoles is lower than those inside the first and the third ones of the three-stage quadrupoles.

8. A mass spectrometric method according to claim 5, further comprising:

selecting a peak, which has the intervals between neighboring peaks on a mass spectrum exceeding a value pre-determined based on the isolation resolution of the mass filter, among peaks on the mass spectrum; and isolating the ion associated with the selected peak in the ion trap.

9. A mass spectrometric method according to claim 8, wherein the selected peak is displayed on a monitor screen.

10. A mass spectrometric method according to claim 5, wherein the mass filter is comprised of three-stage quadrupoles, said spectrometer further comprising:

a means for controlling gas pressure inside the mass filter so that the gas pressure inside the second one of the three-stage quadrupoles is lower than those inside the first and the third ones of the three-stage quadrupoles.

11. A mass spectrometric method according to 5, further comprising:

selecting a peak, which has intervals between neighboring peaks on a mass spectrum exceeding a value pre-determined based on an isolation resolution of the mass filter, among peaks on the mass spectrum;

isolating the ion associated with the selected peak in the ion trap.

12. A mass spectrometric method according to claim 11, wherein the selected peak is displayed on a screen.

13. A mass spectrometric method comprising:

generating sample ions at an ion source;

ejecting the ions after storing the ions generated in the ion source at a 3D quadrupole ion trap for a pre-set period of time;

analyzing the masses of the ions and/or fragments generated by ion dissociation using a Time-of-Flight Mass Spectrometer, wherein the Time-of-Flight Mass Spectrometer accelerates the ions ejected from the ion trap in the direction orthogonal to the direction of their travel;

controlling the gas pressure inside a mass filter disposed between the ion source and the ion trap independently from the gas pressure inside the ion trap;

selecting a peak, which has intervals between neighboring peaks on a mass spectrum exceeding a value predetermined based on an isolation resolution of the mass filter, among peaks on the mass spectrum;

isolating the ion associated with the selected peak in the ion trap.

14. A mass spectrometric method according to claim 13, wherein the selected peak is displayed on a screen.

15. A mass spectrometric method according to claim 13, further comprising:

selecting a peak, which has the intervals between neighboring peaks on a mass spectrum exceeding a value pre-determined based on the isolation resolution of the mass filter, among peaks on the mass spectrum; and isolating the ion associated with the selected peak in the ion trap, wherein a first gas pressure inside the ion trap is set to a higher level than a second gas pressure inside the mass filter in the controlling step.

16. A mass spectrometric method according to claim 15, wherein the selected peak is displayed on a monitor screen.

* * * * *